United States Patent [19]

Fournier et al.

[11] Patent Number: 4,674,546

[45] Date of Patent: Jun. 23, 1987

[54] FUELING NOZZLE VAPOR COLLECTING SYSTEM

[75] Inventors: Paul J. E. Fournier, Jackson; Ernest F. Kulikowski, Marshall, both of Mich.

[73] Assignee: Aeroquip Corporation, Jackson, Mich.

[21] Appl. No.: 769,247

[22] Filed: Aug. 26, 1985

[51] Int. Cl.[4] ..... B65B 39/04; B65B 3/18

[52] U.S. Cl. ..... 141/96; 141/285; 141/392; 222/23; 222/481.5; 285/404

[58] Field of Search ..... 141/95, 96, 285, 286, 141/52, 59, 192, 198, 392; 222/23, 108, 481.5, 318; 403/362; 277/97, 30, 208, 207 A; 16/2; 174/151; 285/205, 206, 404

[56] References Cited

U.S. PATENT DOCUMENTS

| | | | |
|---|---|---|---|
| Re. 31,882 | 5/1985 | Moskovich | 141/5 |
| 1,186,621 | 6/1916 | Townsend | 285/404 X |
| 1,905,324 | 4/1933 | Waters | 277/208 X |
| 2,620,208 | 12/1952 | Patch et al. | 277/30 X |
| 2,850,049 | 9/1958 | Lomax | 141/95 |
| 3,334,821 | 8/1967 | Garrison | 141/96 X |
| 3,710,831 | 1/1973 | Riegel | 141/52 X |
| 3,730,569 | 5/1973 | Feinler | 403/362 |
| 3,734,149 | 5/1973 | Hansel | 141/95 X |
| 3,826,291 | 7/1974 | Steffens | 141/59 |
| 3,907,010 | 9/1975 | Burtis et al. | 141/59 X |
| 3,946,773 | 3/1976 | Hansel | 141/285 X |
| 3,996,977 | 12/1976 | Hansel | 141/285 |
| 4,053,002 | 10/1977 | Ludlow | 141/95 |
| 4,060,108 | 11/1977 | Weston et al. | 141/59 |
| 4,101,140 | 7/1978 | Reid | 277/208 X |
| 4,108,223 | 8/1978 | Hansel | 141/285 X |
| 4,235,266 | 11/1980 | McMath | 141/285 |
| 4,485,856 | 12/1984 | Dulian et al. | 141/95 X |
| 4,544,054 | 10/1985 | Brown | 403/362 X |

*Primary Examiner*—Frank E. Werner
*Assistant Examiner*—P. McCoy Smith
*Attorney, Agent, or Firm*—Beaman & Beaman

[57] ABSTRACT

The invention pertains to a fueling nozzle vapor collecting apparatus attachable to a standard fuel dispensing nozzle spout. The apparatus includes a rigid plate connected to the spout having an annular resilient cup-shaped hood affixed to the plate periphery having a foam cushion defined on its outer edge for sealingly engaging the surface surrounding a fuel tank inlet. A collecting hose for the vapor is attached to a port defined in the plate for venting the vapor to a location remote from the nozzle, and a sight glass is adjustably positionable within a seal located in the plate providing visual observance of the fuel level.

2 Claims, 3 Drawing Figures

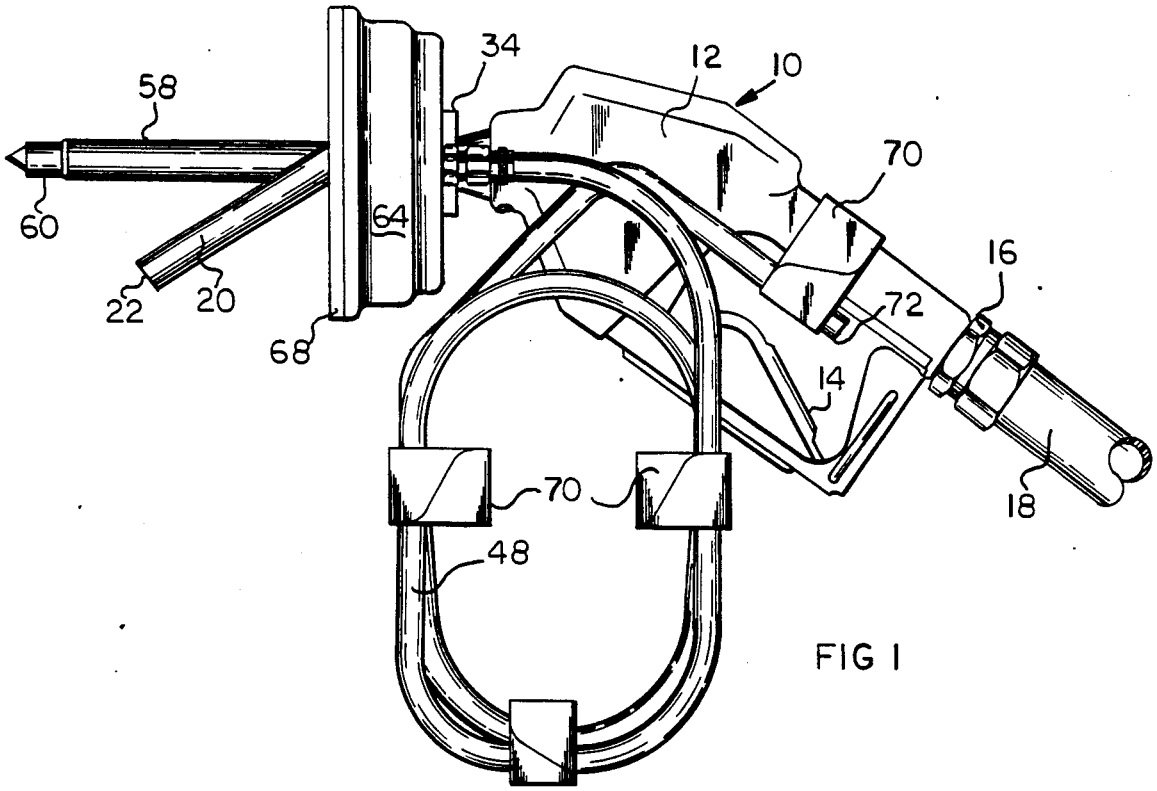
FIG 1
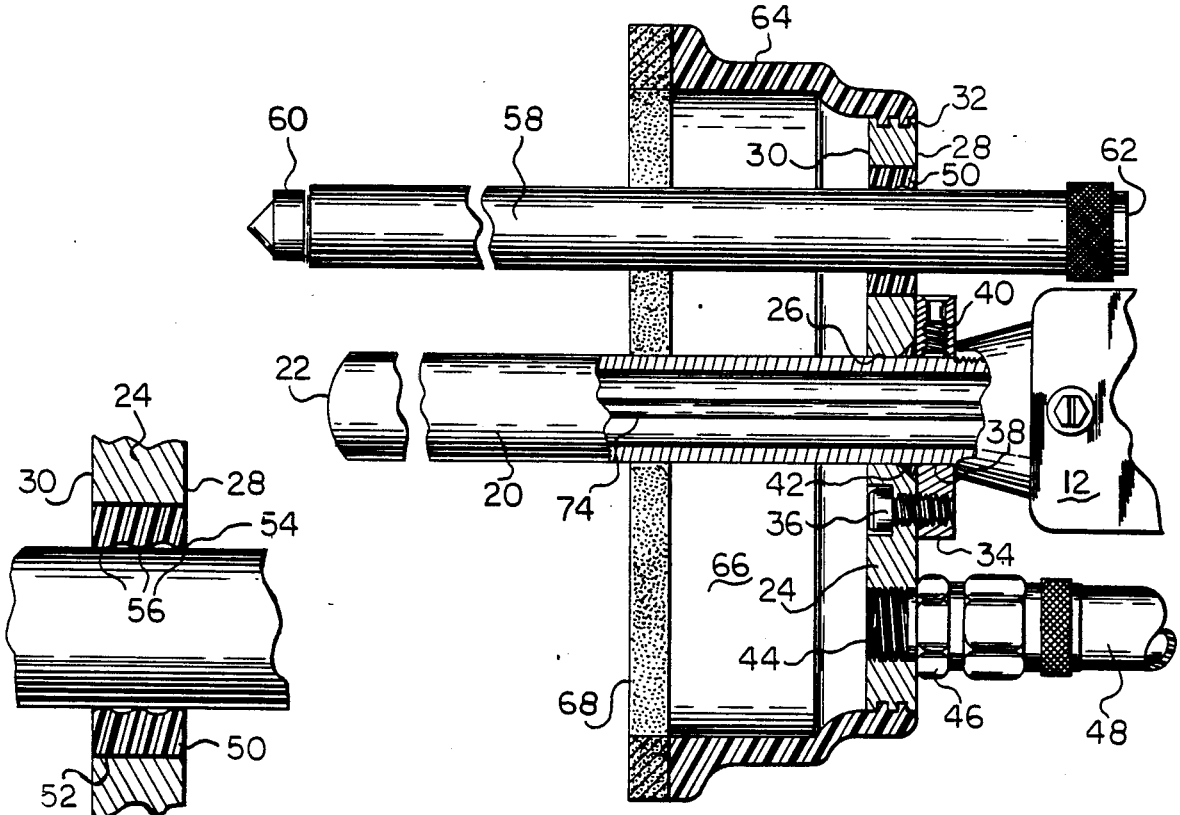
FIG 3
FIG 2

FUELING NOZZLE VAPOR COLLECTING SYSTEM

BACKGRUND OF THE INVENTION

During the filling of fuel tanks of aircraft and land vehicles vapor is forced from the fuel tank as the tank fills. Fuel vapors produce safety hazards and contaminate the atmosphere from an environmental standpoint, and in certain instances the control of such fuel vapors is of utmost importance and various systems have been proposed and developed for collecting fuel tank vapor.

To reduce the duration of the refueling time of military aircraft, such as helicopters, it is desirable to develop safe systems for "hot fueling" the aircraft, i.e. filling the fuel tanks while the engine is running, and in over-wing systems using open fuel tank inlets it is desirable to remove the vapor forced from the fuel tank from the proximity of the aircraft for safety purposes.

While vapor collecting and capturing systems for use during the filling of fuel tanks are known, such apparatus as available often requires special nozzles and expensive custom designed apparatus, and it is a purpose of the invention to provide a vapor collecting apparatus which may be readily mounted upon conventional fuel dispensing nozzles which is of inexpensive construction, and is capable of effectively collecting fuel vapor at the tank inlet and venting the vapor to a location remote from the tank.

Another object of the invention is to provide a vapor collecting apparatus for use with a conventional fuel dispensing nozzle wherein the apparatus collects all of the vapor being released from a fuel tank inlet, and wherein the apparatus utilizes flexible means for sealing the apparatus relative to the fuel tank inlet and its environs to compensate for misalignment of the nozzle and inlet.

A further object of the invention is to provide vapor collecting apparatus for a conventional fuel dispensing nozzle which incorporates a sight glass for permitting observance of the fuel level within a tank being filled wherein the sight glass may be readily adjusted relative to the vapor collecting apparatus, and the seal between the vapor collecting apparatus and the sight glass is maintained even though limited relative movement therebetween may occur.

In the practice of the invention the fuel vapor collecting apparatus is mounted upon a conventional spout of a fuel dispensing nozzle and no structural modification to the spout or nozzle is required. The apparatus includes a rigid circular primary plate having a central opening defined therein whereby the plate may be slipped upon the nozzle over its outer free end, and a mounting plate affixed to the primary plate includes an opening coincident with the primary plate opening and a set screw mounted therein attaches the plate structure to the nozzle spout.

An axially extending annular flexible hood formed of rubberlike material is, at one end, attached to the primary plate periphery and the hood open end extends toward the spout free end. At its open annular end the hood is provided with an axially extending closed cell foam which engages and seals against the structure adjacent the fuel tank inlet for capturing vapor being forced from the fuel tank during refueling.

A resilient annular seal is located within the primary plate having a bore slidably receiving an elongated light transmitting sight glass having an outer end receivable within the tank inlet, and an outer end observable by the nozzle operator. By axially adjusting the sight glass within its seal, the "depth" that the sight glass extends into the fuel tank may be readily adjusted. The sight glass seal includes resilient seal structure of a flexible nature as defined by annular ridges wherein sealing between the sight glass and primary plate is maintained even though limited lateral deflection of the sight glass with respect to the axis of the sight glass seal occurs.

A vapor transmitting port is defined in the primary plate to which a flexible venting hose is attached. The venting hose is provided with a plurality of spaced connectors thereon wherein the venting hose may be attached side-by-side to the fuel supply hose of the nozzle for maintaining the venting hose in an extended condition to assure release of the collected vapor at a distance remote from the fuel nozzle.

BRIEF DESCRIPTION OF THE DRAWINGS

The aforementioned objects and advantages of the invention will be appreciated from the following description and accompanying drawings wherein:

FIG. 1 is an elevational view of a fuel dispensing nozzle utilizing the vapor collecting apparatus of the invention, the vent hose being illustrated in the coiled, nonuse condition, FIG. 2 is an enlarged, plan, sectional view of vapor collecting apparatus for a fuel nozzle in accord with the invention, illustrated as mounted upon a nozzle spout, and FIG. 3 is an enlarged, detail, diametrical, sectional view of the sight glass seal and sight glass as mounted therein.

DESCRIPTION OF THE PREFERRED EMBODIMENT

With reference to FIG. 1, a conventional fuel dispensing nozzle is represented at 10 including a body 12 in which a valve, not shown, is controlled by the hand-operated lever 14. The nozzle is supplied with fuel through fitting 16 which is attached to a flexible fuel supply hose 18, as well known. A cylindrical spout 20 extends from the nozzle body 12 having a free outer end 22 for insertion into a fuel tank inlet. The fuel nozzle 10 is of conventional structure and in itself forms no part of the present invention.

The vapor collecting apparatus is mounted upon the nozzle spout 20 and includes a rigid support plate 24, preferably formed of aluminum, having a central cylindrical opening 26 of a diameter slightly larger than the spout diameter wherein the plate 24 may be slipped over the spout free end 22 for positioning as shown in FIGS. 1 and 2.

The plate 24 includes an outer side 28 and an inner side 30 and the circular periphery of the plate is provided with radial ridges 32 wherein the hood is bonded thereto, as described below. A circular mounting plate 34 is attached to the outer side 28 of the plate 24 by three cap screws 36 spaced at 120° intervals about the mounting plate opening 38 closely receiving the nozzle spout and coaxial with the plate opening 26. A radially disposed set screw 40 located within a radial threaded hole in the mounting plate 34 permits the set screw to be tightened against the spout 20 for positioning the plate 24 thereon. The outer side 28 of the plate 24 is countersunk adjacent the opening 26 for receiving a nitril sealing ring 42 which is compressed by plate 34 and seals against the nozzle spout to prevent the escape of vapor through the plate opening 26.

The plate 24 includes a threaded vent port 44 extending therethrough and the vent fitting 46 is threaded therein. The flexible vent hose 48 attaches to the fitting 46, and is of such length, approximately 20 feet, as to vent the vapors to the atmosphere a substantial distance from the nozzle 10.

An annular nitril seal 50 is bonded within an opening 52 defined within the plate 24. The seal 50 includes a bore 54 of generally circular configuration, but the seal bore includes a plurality of axially spaced annular radially extending ridges 56, FIG. 3, which provide an extended degree of flexibility of sealing with respect to the sight glass 58 received within the seal bore 54 and engaged by the ridges 56.

The sight glass 58 is of an elongated form including a shaped inner end 60, and an outer end 62. The cylindrical body of the sight glass is of a light transmitting synthetic plastic material, such as sold under the trademark Prismalite, and the inner end 60 is of such configuration that the immersion of the inner end within fuel is visually observable at the outer end 62 by the nozzle operator by a color change at end 62. The sight glass 58 is firmly received within the seal 50 but may be axially positioned therein to vary the degree of extension of the inner end 60 into the fuel inlet. As the ridges 56 engage the sight glass and provide a greater degree of flexibility than would be possible without their presence, the ridges permit the sealed relationship between the sight glass 58 and the seal 50 to be maintained even though the sight glass end 60 is laterally deflected from the seal bore axis to a limited degree. Such deflection or tilting of the sight glass inner end may occur due to engagement of the end 60 with a fuel tank inlet neck.

The annular hood 64 bonded to the plate 24 upon ridges 32 is formed of nitril, and accordingly, is of a flexible resilient nature and defines a chamber 66 adjacent the plate inner side 30. At its free outer end the hood 64 supports the annular lip seal 68 which is formed of a closed cell foam material impervious and chemically inert with respect to fuel and fuel vapor. The lip seal 68 is compressible to accommodate rivets and seams adjacent the fuel tank inlet, and as the hood 64 is also flexible, the vapor collecting apparatus will readily conform to the configuration required to maintain a sealed relationship with the fuel tank inlet even though there may be a slight misalignment of the nozzle with respect to the inlet.

A plurality of straps 70 are used with the vent hose 48 which are axially spaced along the vent hose to strap the hose 48 side-by-side to the fuel supply hose 18 in order to maintain the vent hose in an extended condition to insure that the fumes are not discharged to the atmosphere adjacent the fuel nozzle. The straps 70 are preferably of the type sold under the trademark "Velcro" consisting of small hooks releasably engagable with loops, and the straps may be used to hold the vent hose in a coil as shown in FIG. 1, when the nozzle is not in use, and upon disposing the vent hose 48 adjacent the fuel supply hose 18, the straps are used to attach the vent and supply hoses together.

The vapor collecting apparatus of the invention is mounted upon the nozzle spout 20 in the manner described and illustrated. The seal ring 42 will seal the plate 24 to the spout, and tightening of the set screw 40 positions the plate upon the spout adjacent the nozzle body.

When fueling, the vent hose 48 is placed alongside the fuel supply hose 18 and strapped thereto by straps 70 which locates the open end 72 of the vent hose at a location remote from the nozzle 10 and the location of fueling.

To fuel an aircraft, or the like, the tank inlet, not shown, would be substantially vertically disposed having a substantially horizontal rim located adjacent a wing or fuselage surface, and the nozzle spout 20 would be inserted therein. The sight glass 58 would also extend into the neck of the fuel tank inlet, and the spout is inserted into the tank inlet until the lip seal 68 firmly engages the wing or fuselage surface adjacent the fuel inlet. The compressible nature of the lip seal 68 permits the lip seal to conform to rivets and seams, and the flexible resilient nature of the hood 64 permits the lip seal to firmly engage the surface structure adjacent the tank inlet even though the nozzle may not be accurately aligned with the tank inlet.

The nozzle lever 14 controls the flow of fuel into the inlet, and as the tank is filled the vapor within the tank is expelled into the chamber 66 and passed through the vent port 44 into the vent hose 48 for release into the atmosphere at a location remote from the aircraft being fueled. The nozzle 10 will normally include an automatic shutoff sensing tube 74, FIG. 2, which senses the presence of fuel when the fuel level engages the nozzle end 22, but if the inner end of the sight glass extends inwardly beyond the end 22 of the spout the operator will be able to observe when the fuel level reaches the sight glass inner end 60 by the change of color occurring at sight glass end 62.

The sight glass 58 is particularly useful when fueling interior auxillary aircraft tanks in those instances wherein it is desired to know when the fuel level reaches a predetermined location below the tank inlet. By axially adjusting the position of the sight glass 58 within the plate 24 a predetermined amount of fuel may be located within a tank, and such fuel level readily determined by the nozzle operator.

It will be appreciated that the aforedescribed vapor collecting apparatus is readily installable upon a conventional fuel dispensing nozzle, is of economical construction, and capable of producing an efficient sealed relationship adjacent a fuel tank inlet for capturing vapor, and it is appreciated that various modifications to the inventive concepts may be apparent to those skilled in the art without departing from the spirit and scope of the invention.

We claim:

1. Vapor collecting apparatus for fuel nozzles having an elongated spout and connected to a fuel supply hose comprising, in combination, a support plate having a periphery, an inner side, an outer side and a spout receiving opening intersecting said sides, spout attachment means defined on said plate outer side comprising a mounting plate having a spout receiving opening in alignment with said support plate opening and attached to said support plate outer side by a plurality of screws, an annular elastic seal ring located intermediate said support plate outer side and said mounting plate adjacent said support plate opening, said mounting plate compressing said seal ring upon tightening of said screws to seal said ring and support plate relative to the nozzle spout, an annular elastomeric flexible hood having an axis and inner and outer ends, said hood inner end being affixed to said support plate periphery and said hood axially extending from said support plate outer side, an axially extending annular seal cushion mounted upon said hood outer end, a vapor port defined in said support plate intersecting said support plate sides, a flexible venting hose communicating with said port, sight glass mounting means defined in said support plate comprising an annular resilient seal having a bore having an axis, and a light transmitting elongated sight glass sealingly received within said sight glass mounting means seal bore having as inner end defined on said plate inner side and extending through said hood and an outer end located exteriorly of said plate outer side observable by the nozzle operator whereby contact of said sight glass inner end with a fuel level is observable by the nozzle operator, said sight glass being sealingly received within said seal bore and axially displaceably adjustable therein.

2. In vapor collecting apparatus as in claim 1, a plurality of flexible annular ridges coaxially defined in said sight glass mounting seal bore engaging said sight glass maintaining the seal between said sight glass mounting seal and sight glass during limited lateral deflection of an end of said sight glass with respect to the axis of said seal bore.

* * * * *